United States Patent [19]

Crocco

[11] Patent Number: 4,855,973

[45] Date of Patent: Aug. 8, 1989

[54] WRISTBAND, COMPRISING TWO STRAPS IN WHICH ONE STRAP PASSES THROUGH AN OPENING OF THE OTHER STRAP

[75] Inventor: Carlo Crocco, Lugano, Switzerland

[73] Assignee: C & KN Hobby Design S.A., Switzerland

[21] Appl. No.: 112,831

[22] PCT Filed: Feb. 12, 1987

[86] PCT No.: PCT/CH87/00019

§ 371 Date: Oct. 5, 1987

§ 102(e) Date: Oct. 5, 1987

[87] PCT Pub. No.: WO87/04907

PCT Pub. Date: Aug. 27, 1987

[30] Foreign Application Priority Data

Feb. 18, 1986 [CH] Switzerland ..... 645/86

[51] Int. Cl.[4] ..... G04B 37/00

[52] U.S. Cl. ..... 368/282; 224/176

[58] Field of Search ..... 368/280–282, 368/276; 224/164–180; 24/265 WS, 265 R

[56] References Cited

U.S. PATENT DOCUMENTS 2,466,741 4/1949 Roehrl ..... 224/176
4,178,751 12/1979 Liautaud ..... 368/281

FOREIGN PATENT DOCUMENTS 2308326 11/1976 France .
271713 11/1950 Switzerland .
403369 6/1966 Switzerland .
396132 8/1933 United Kingdom .

*Primary Examiner*—Bernard Roskoski
*Attorney, Agent, or Firm*—McGlew & Tuttle

[57] ABSTRACT

A wristband for use with a wristwatch case comprising a first strap and a second strap. One end of each strap is preferably formed integral with the case. The first strap has a plurality of openings, one succeeding another along the length of the first strap. The second strap has a prolonged portion on an end opposite the end connected to the wristwatch case. The prolonged portion or band is intended to pass through one of the openings of the first strap to form a closed loop. A fastening construction is provided for connecting a free end of the prolonged portion which has passed through the opening 6 with a fastener associated with the second strap.

11 Claims, 1 Drawing Sheet

WRISTBAND, COMPRISING TWO STRAPS IN WHICH ONE STRAP PASSES THROUGH AN OPENING OF THE OTHER STRAP

BACKGROUND OF THE INVENTION

The present invention relates to a wristband, notably for a watch case. It relates more particularly to a wristband made of injected synthetic material.

Such wristbands are generally known. They are formed of two straps starting from the case and, in the existing realizations, the connection between the straps is obtained by means of a loop fastened to the end of one of the straps to receive the end of the other strap.

The loop must be manufactured separately and then mounted on the wristband. As a result, the cost of the wristband is increased. The added expense is a problem as synthetic material wristbands are intended to be an inexpensive product. An alternative is to use loops where the strap is held by pinching, as is often used with this kind of products. However, with such a strap held by pinching, there is risk of accidental opening of the wristband, entailing loss of the watch.

SUMMARY AND OBJECTS OF THE INVENTION

The present invention proposes to remedy these drawbacks by making a wristband which is very inexpensive to manufacture and offers great wearing safety.

According to the invention, a wristband, notably for a case, is provided comprising a first and a second strap, one end of each strap being integral with the watch case. Each strap has special features. The first strap has openings succeeding each other along the length of the wristband. The second strap is prolonged, on the side opposite the watch case end, by a band intended to pass through one of the openings to form with the two straps and the case a closed loop, and that the fastening means permit making the free end of the band integral with a point of the assembly formed by the second strap and the band.

The various features of novelty which characterize the invention are pointed with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENT

Figure 1:
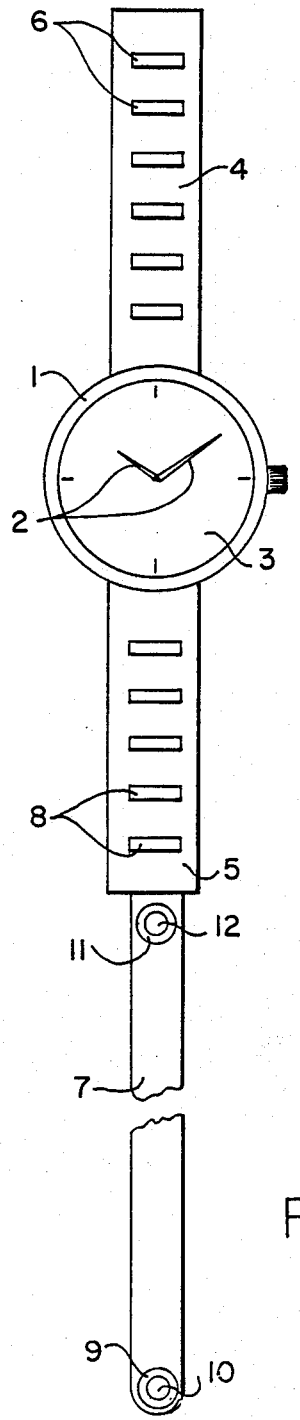
FIG. 1 is a plan view of a watch case, containing a movement with the indicators, provided with a wristband according to the invention, the wristband being spread out; and, FIG. 2 shows in a side view the watch case and the wristband illustrated in FIG. 1, the wristband forming a loop.
Figure 2:
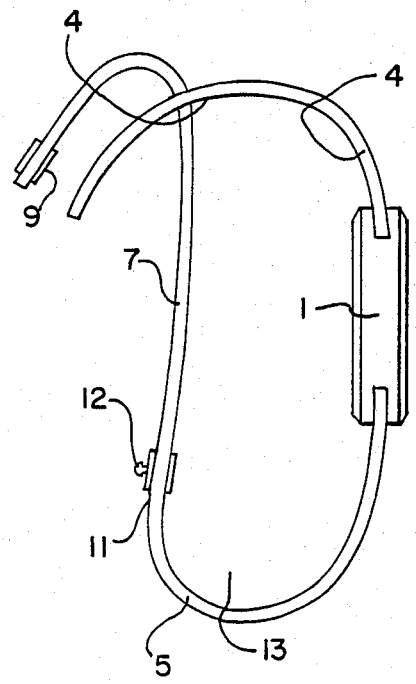

The figures of the drawing represent a case 1, for example with a watch case, and a wristband according to the invention belonging to this case. In case 1 is disposed a mechanical and electronic movement not shown, which drives the hands 2 before a dial 3. The wristband is formed by a first strap 4 and by a second strap 5, one end of each strap being integral with the case 1.

In a preferred form of execution, the wristband is made of injected synthetic material in one piece with the case. The invention, of course, applies also to a wristband of synthetic, or any other material, which would be fastened to the case by conventional means, using, for example, a bar or lug penetrating into the horns of the case.

The first strap 4 has a series of rectangular openings 6, all identical. These openings are disposed in succession along the longitudinal direction of the wristband, the long sides of these openings being oriented perpendicularly to the field.

The free end of the second strap 5 is prolonged by a flexible band 7. Preferably this band forms with the strap one and the same piece of synthetic material. Other executions are also possible. Thus, the band could be a separate element, attached on the strap, for example by gluing. It could also be made of a material other than synthetic material, this material being the same as or different from that of the strap.

Band 7 has a thickness substantially equal to that of strap 5 and a rectangular cross section with dimensions permitting it to be introduced in one of the openings 6 of strap 4. Strap 5 may advantageously also have openings 8, identical with the openings 6 and disposed in the same manner. The openings 8, making the two straps look alike, have only a decorative purpose.

Fastening means, for example, a snap button formed of two parts, make it possible to connect the free end of band 7 to a point of the assembly formed by the band and the strap 5. To this end, one of the parts of the snap button, marked 9, with a central opening 10, is disposed at the free end of the band, while the other part, marked 11, provided with a catch 12, is placed on the band near its junction with strap 5.

Strap 4, case 1, strap 5 and band 7 permit forming a closed loop 13, intended to be passed around the wrist of the wearer of the watch, by introducing the free end of band 7 into one of the openings 6 of strap 4. Passage of the band through the opening is made possible, despite the volume of part 9, by slightly deforming the strap 4 so as to enlarge the opening 6. Part 6 then constitutes a safety stop for the band 7 when the snap button is not closed. The loop 13 presents, in this case, a maximum length which makes it easy to place the watch on the arm.

Once the watch is in place, it suffices to close the snap button by forcibly applying part 9 on part 11. The length of the loop 13 is thereby reduced and the wristband adjusted to the dimensions of the wrist. If this is not the case, a better adjustment can be obtained by causing the band 7 to pass through another opening 6 of strap 4.

While a specific embodiment of the invention has been shown and described in detail to illustrate the application of the principals of the invention, it will be understood that the invention may be embodied otherwise without departing from such principles.

I claim:

1. A wristband for use with a wristwatch case, comprising: a first strap having a first end for connection to a wristwatch case and a second end opposite the first strap first end, said first strap having a plurality of openings, one opening succeeding another opening along the length of the first strap; a second strap having a first end for connection to the wristwatch case and a second, elongate prolonged free end opposite said second strap first end, said second strap elongate prolonged free end being adapted to pass through one of the openings of said first strap such that the first strap and the second strap form a closed loop; fastening means for fastening the elongate prolonged free end of said second strap to a portion of said second strap intermediate said elongate prolonged free end and said second strap first end said second strap elongate prolonged free end being adapted to be reversely bent during passage through the one opening to overlie the said portion of said second strap progressively to tighten the loop and to enable operation of the fastening means.

2. A wristband according to claim 1, wherein: said fastening means comprising a first snap button part connected to the second end of said second strap and a second snap button part connected to said second strap between said second strap first end and second end.

3. A wristband according to claim 1, wherein: said second strap includes a plurality of openings, one opening succeeding another opening along the length of the second strap to provide the same appearance as the first strap.

4. A wristband according to claim 1, wherein: first wristband, the second wristband and the second wristband prolonged portion are each formed of injected synthetic material.

5. A combination wristband and watch case comprising: a frist strap having a first end integral with the watch case and a second end, said first strap being formed with a plurality of openings including a first opening succeeded by other openings along the length of the wristband each opening being elongate and extending across the width of the wristband; a second strap having a first end integral with the watch case and having a second end; an elongate, prolonged portion having a first end connected to the second end of said second wrist strap and a second free end, the prolonged portion having a width less than the width of the first strap so that the prolonged portion is insertable second, free end leading into a selected one of the openings of said first strap to form a closed loop; fastening means including a first fastening element at said second free end of said elongate prolonged portion and a second fastening element adjacent said second end of said second strap, whereby, when inserted into a selected one of said openings, the prolonged portion can be progressively drawn through the opening to tighten the band and reversely bent to overly itself bringing the first and second fastening elements into registration enabling the two straps to be maintained in a closed loop by fastening the first fastening element to the second fastening element.

6. A wristband according to claim 5, wherein: said first element of said first fastening means includes a first snap button part and said second fastening element of said fastening means includes a second snap button part, said first snap button part is positioned at the second end of said prolonged portion and said second snap button part is positioned at said first end of said snap button part adjacent said second strap.

7. A wristband according to claim 5, wherein: said second strap includes a plurality of openings including a first opening and opening succeeding the first opening along the length of the wristband, so said second strap has the same appearance as said first strap.

8. A wristband according to claim 5, wherein: said first strap and said second strap are each formed of injected synthetic material.

9. A wristband according to claim 5, wherein: said second strap and said prolonged portion are formed integral.

10. A wristband according to claim 5, wherein: said first strap, said second strap, said prolonged portion and said watch case are formed integral of injected synthetic material.

11. A combination wristband and watch case, comprising: a watch case, a first strap having one end formed integral with said watch case; a second wrist strap having a first end formed integral with said watch case, each of said first wrist strap and said second wrist strap having a plurality of openings including a first opening adjacent the watch case and succeeding openings along the length of each respective strap; each opening being elongate and extending across the strap width; a prolonged portion having a first end formed integral with said second strap and an elongate second end portion terminating in a second free end opposite said first end; a first snap fastening part formed integral with said prolonged portion and positioned at said first end of said prolonged portion adjacent said second strap; and, a second snap fastening part formed integral with said prolonged portion at said second end of said prolonged portion, said elongate second end portion of the prolonged portion having a width less than the width of the first strap so that said elongate second end portion of said prolonged portion is adapted to pass, free end leading through one of said openings of said first strap to form a closed loop including said first strap, said watch case, said second strap and said prolonged portion, and subsequently to be reversely bent at its passage through the loop and drawn back over itself to tighten the loop and bring said first snap fastening part into snap engagement with said second snap fastening part thereby forming a fastened closed loop.

* * * * *